United States Patent [19]

Jean

[11] 4,240,452

[45] Dec. 23, 1980

[54] ELASTIC BASE TOOTHBRUSH

[76] Inventor: San-Bau Jean, No. 25, Lane 31, Min-Yo St., Lou Tong, Taiwan

[21] Appl. No.: 75,190

[22] Filed: Sep. 13, 1979

[51] Int. Cl.[3] ..... A45D 44/18

[52] U.S. Cl. ..... 132/84 R; 15/201

[58] Field of Search ..... 132/84 R; 15/167, 201, 15/191 R, 190, 184

[56] References Cited

U.S. PATENT DOCUMENTS

| | | | |
|---|---|---|---|
| 2,882,544 | 4/1959 | Hadidian | 15/167 |
| 2,935,755 | 5/1960 | Leira et al. | 15/167 |
| 3,879,791 | 4/1975 | Isler | 15/201 |

*Primary Examiner*—G. E. McNeill

*Attorney, Agent, or Firm*—Armstrong, Nikaido, Marmelstein & Kubovcik

[57] ABSTRACT

This invention relates to an elastic base toothbrush, wherein the base body comprises a loop groove, several elastic rubber tubes, a plastic plate with bunches of brush within its holes, brush bearings of which said plastic plate is held by flange above said groove; each bunch of said brush is movable within the hole of said plastic plate and is held by the expanded portion of said brush bearing without escaping therefrom; several holes are provided at the front and rear end of the base body for flowing the remaining water out and keeping the base body dry; said rubber tubes act as an elastic base for brush to tightly contact with the teeth according to the outlines of the teeth such that the impurities in the teeth space may be thoroughly cleared off.

1 Claim, 4 Drawing Figures

ELASTIC BASE TOOTHBRUSH

BACKGROUND OF THE INVENTION

The present invention relates to an elastic toothbrush and more particularly to a toothbrush having an elastic base for adequately fitting the said brush to the outlines of the teeth and cleaning the teeth thouroughly. The conventional toothbrush, especially those which are just produced from the factory having bunches of hard and strong brushes, which are usually unbending 50 that the impurities in the concavities of the teeth can not be cleared off; moreover, the said impurities always cause the tooth disease such as caries, odontorrhagia or odontitie etc. In contrast, the present invention is provided with a flexible toothbrush for eliminating the foregoing disadvantages, by which not only the teeth can be thououghly cleaned but also the teeth ridge comfortably massaged.

SUMMARY OF THE INVENTION

Briefly described, the present invention is to provide a toothbrush with an elastic base, of which a loop groove is provided at the periphery therein, three elastic rubber tubes are mounted in said base body, a plastic plate with rows of holes fixing above the rubber tubes is held in the base body by means of the flange above said groove. Each bunch of the brushes planted in the said hole is clamped through the brush bearing. The lower part of each bunch bearing is of an expanded shape to form a flange for keeping said bearing without releasing it from the plastic plate. Three holes are provided at the front end of the groove while two holes are at the rear end of the groove, through which the water may flow out that the toothbrush can be kept dry after being used.

DETAILED DESCRIPTION OF THE PRESENT INVENTION

Figure 1:
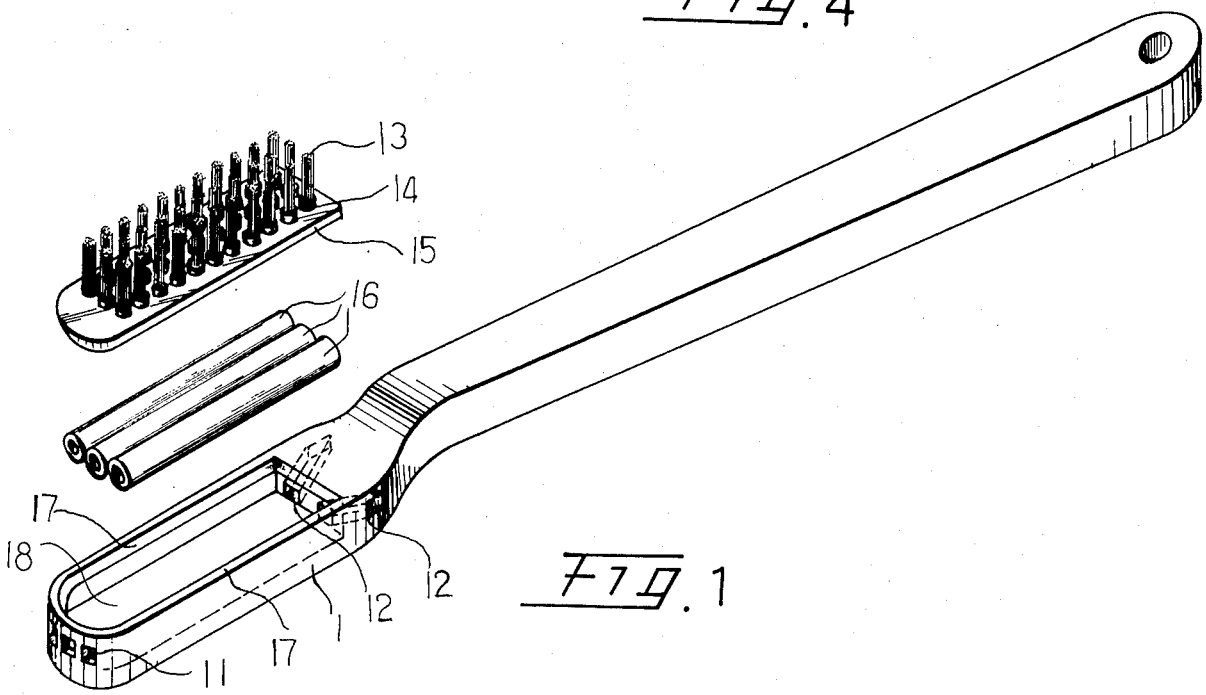
FIG. 1 is a perspective view of the combined elements of an elastic base toothbrush according to the present invention.

The present invention may be better understood by referring to the drawings. FIG. 1 shows a perspective view of the combined elements of an elastic base toothbrush according to the present invention. Which comprises a loop groove (18) in the base body (1), three holes (11) are provided at the front end of the said groove while two holes (12) at the rear end; a loop flange (17) is provided at the upper portion of the base body (1) for holding the plastic plate, three elastic rubber tubes (16) having the equal length and radius are fixed within the grooved base body, a plastic plate (15) with several rows of holes for planting bunches of bush (13) is hold by the said flange (17) wherein the bunches of brush are clamped through the brush bearings (14) and the number of the holes on the plastic plate (15) equals to the number of the rubber tubes (16).

Figure 2:
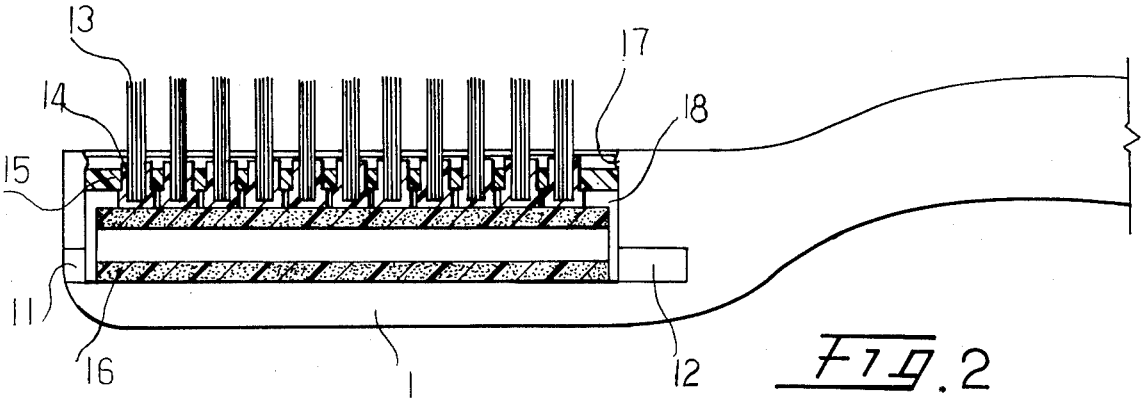
FIG. 2 is a sectional view of the elastic base toothbrush according to the present invention.

FIG. 2 shows a sectional view of the elastic base toothbrush according to the present invention, the expanded portion of the lower part of the brush bearing (14) is provided for preventing itself escaping from the plastic plate (15). Said plate (15) is held by the said flange (17); holes (11) and (12) are provided for flowing the remaining water out while the water penetrates therein.

Figure 3:
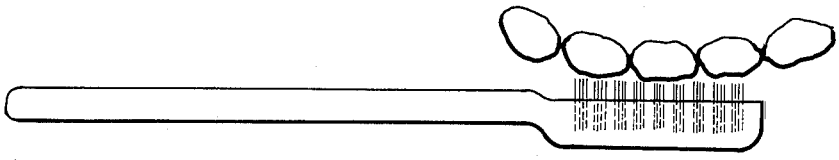
FIG. 3 is a perspective view of an embodiment of the conventional toothbrush.

FIG. 3 shows an embodiment of the conventional toothbrush, the conventional brush is sturdily fixed on the base body a toothbrush and cannot be flexibly moved upward or downward according to the outlines of the teeth, thus the impurities remaining in the teeth can not be thouroughly removed, moreover, the sturdy brush may even hurt the teeth.

Figure 4:
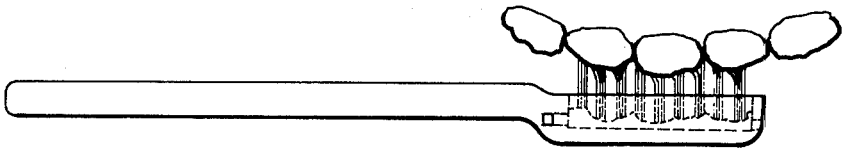
FIG. 4 is a perspective view of an embodiment of the present invention.

An preferred embodiment of the elastic base toothbrush according to the present invention is described referring to FIG. 4, the rubber tubes are provided for performing a wave-like action while the bunches of the brush are moved upward and downward according to the outlines of the teeth, it provides not only an effect of massaging the teeth gum while the gum is touched by the flexible brush but also an effect of an entire clearnese while the impurities in the concavities of teeth are clearned off by the complete touching surface of brush.

As has been previously stated and readily understood, the purpose of the present invention is to provide a toothbrush wherein the brush may be moved upward and downward for providing an effect of massaging and clearness.

The present invention has been described in detail above for purpose of illustration only and is not intended to be limited by this description or otherwise to exclude any variation or equivalent arrangement that would be apparent from, or reasonably suggested by, the foregoing disclosure to the skill of the art.

I claim:

1. An elastic base toothbrush comprises a handle with a base body having a loop groove therein, several rubber tubes, a plastic plate with rows of holes, bunches of brushes and brush bearings; wherein three holes are formed at the front end of said groove and two holes at the rear end for flowing the remaining water out; said rubber tubes are fixed within the base portion surrounded by said loop groove for providing an elastic base, said plastic plate on said rubber tubes is held by the flange above said groove, bunches of brush carried in said plate are held through said rows of holes by means of the expanded lower part of said bearings to prevent said brush escaping from the base body; the number of said rows of holes is equal to that of said rubber tubes; which is characterized in that the brush is adequately moved upward or downward according to the outline of the teeth shape by means of the elastic rubber tubes and brush bearings.

* * * * *